United States Patent [19]

Szego

[11] 4,361,190

[45] Nov. 30, 1982

[54] METHOD AND APPARATUS FOR PROVIDING A TRAVERSABLE PATHWAY THROUGH A POOL OF FLAMMABLE FLUID

[75] Inventor: Andrew Szego, Willowdale, Canada

[73] Assignee: Vulcan Industrial Packaging Limited, Rexdale, Canada

[21] Appl. No.: 184,283

[22] Filed: Sep. 5, 1980

[30] Foreign Application Priority Data

Sep. 7, 1979 [GB] United Kingdom ..... 7931025

[51] Int. Cl.[3] ..... A62C 7/00

[52] U.S. Cl. ..... 169/48; 220/88 A; 404/35

[58] Field of Search ..... 169/48, 51, 52, 54, 169/70, 49, 45; 220/88 A, 216; 14/1, 2.4, 27; 404/35

[56] References Cited

U.S. PATENT DOCUMENTS

| | | | |
|---|---|---|---|
| 596,867 | 1/1898 | Frick | 14/2.4 |
| 601,374 | 3/1926 | Vanginot | 220/88 A |
| 1,290,015 | 12/1918 | Penfield | 294/63 R |
| 1,612,104 | 12/1926 | Eichengrun | 169/45 |
| 1,857,788 | 5/1932 | Murphy | 169/46 |
| 2,922,344 | 1/1960 | Meissner | 404/35 |
| 3,046,850 | 7/1962 | Tellesson et al. | 404/35 |
| 3,134,116 | 3/1964 | Adkins et al. | 14/1 |
| 3,229,769 | 1/1966 | Bashaw et al. | 169/45 |
| 3,356,256 | 12/1967 | Szego | 220/88 A |
| 3,887,060 | 6/1975 | Kamphues | 198/458 X |
| 3,973,795 | 8/1976 | Goransson | 294/87 R X |
| 3,976,825 | 8/1976 | Anderberg | 169/48 |
| 4,047,257 | 9/1977 | Bondarchuk | 14/27 |
| 4,145,786 | 3/1979 | Myers | 14/27 |
| 4,182,442 | 1/1980 | Jones | 198/486 X |
| 4,249,669 | 2/1981 | Szego | 220/88 A |
| 4,273,489 | 6/1981 | Lingl, Jr. et al. | 414/60 |

FOREIGN PATENT DOCUMENTS

| | | | |
|---|---|---|---|
| 7701672 | 6/1977 | Fed. Rep. of Germany . | |
| 364181 | 8/1962 | France | 169/51 |
| 2294288 | 7/1976 | France | 169/48 |
| 7710394 | 9/1977 | Switzerland | 169/48 |
| 336785 | 10/1930 | United Kingdom | 169/48 |
| 927949 | 6/1963 | United Kingdom | 169/48 |
| 1584322 | 2/1981 | United Kingdom . | |

*Primary Examiner*—F. J. Bartuska
*Assistant Examiner*—Kenneth Noland
*Attorney, Agent, or Firm*—Ridout & Maybee

[57] ABSTRACT

Platform elements each comprising a porous blanket material are deployed end-to-end to form a continuous traversable pathway through a pool of flammable fluid. The blanket material is heat-resistant and of thickness sufficient to prevent penetration of flame from its top surface to the fluid that is in contact with the bottom surface of the blanket.

23 Claims, 8 Drawing Figures

METHOD AND APPARATUS FOR PROVIDING A TRAVERSABLE PATHWAY THROUGH A POOL OF FLAMMABLE FLUID

BRIEF SUMMARY OF THE INVENTION

The present invention provides a method for providing a traversable pathway through a pool of flammable fluid comprising: deploying in contact with the pool in contiguous end-to-end relationship a plurality of platform elements each comprising a blanket of porous non-capillary, heat-resistant material with a thickness exposed above the surface sufficient to prevent penetration of flame from the upper surface of the blanket to the flammable fluid, the elements each being adapted to support the weight of one or more persons thereon without substantial deformation, and thereby forming a substantially continuous elongated pathway.

The function of the blanket material is to prevent or control combustion of the flammable fluid in the locality of the platform element so that either there is no combustion at the upper surface of the platform element or any combustion is limited to small intermittently ignited pockets of flame so that in either event the upper surface of the pathway can be traversed with greatly reduced risk.

When a pool of flammable fuel or other liquid becomes ignited and the surface of the liquid becomes ignited and the surface of the liquid becomes heated, in areas of the liquid that are not covered by the platform elements of the invention, the vapor pressure of the fuel is raised and the evaporation rate of the fuel increases.

However, in areas in contact with the blanket material, since this presents a large surface area, it dissipates heat rapidly to the atmosphere and so remains significantly cooler than the fuel. As the fuel vapors rise, mechanical interference from the blanket material restricts their free passage allowing them prolonged contact with the blanket material. Much of the vapors condense on the cooler blanket material and are returned to the liquid pool. The net evaporation rate, which is the rate of evaporation at the blanket-fule interface less the rate of fuel condensation, is, therefore, significantly reduced.

The net evaporation rate is inversely proportional to the surface of the blanket and wind velocity over the blanket surface. A larger portion of blanket material, by virtue of its greater surface area, dissipates heat more rapidly, and greater wind velocity over its surface carries the heat away quickly.

A fuel-vapor-air mixture cannot be ignited unless the ratio of vapor to air lies within certain well-defined limits called the lower and upper limits of flammability. The least concentration (percentage by volume) of fuel vapor in a vapor-air mixture that can be ignited is called the lower limit of flammability. Similarly, the highest percentage by volume of fuel vapor in air that can be ignited is called the upper or higher limit of flammability. The region between these two percentages is called the flammable range. The flash point is the lowest temperature at which the vapor pressure of the liquid is sufficient to produce a mixture at the lower limit of flammability.

In use of the present invention, ambient conditions permitting, until the top surface of the blanket material reaches at least the flash point temperature of the fuel to permit over its surface a vapor-air mixture within the flammable range, an ignition source will not be able to bring about combustion.

For a volatile hydrocarbon such as gasoline, because its flash point is well below 0° F. at atmospheric pressure, at ordinary temperatures the vapor pressure of gasoline is high enough to produce an equilibrium mixture above the upper limit of flammability. There, however, exists a flammable range above this rich vapor-air mixture. If the top surface of the blanket is above the vapor-air mixture at its lower limit of flammability, combustion cannot take place. Only raising the temperature of the fuel will push the flammable vapor-air mixture above the surface of the blanket material.

In use, flames of the very short duration may ignite pockets of properly-proportioned vapor-air mixture above the blanket surface. In a system unprotected by the present invention, continuing flames can volatilize the fuel and ignite the released vapors. Once the chemical reaction of the combustion has started, the heat of the reaction releases the energy needed to perpetuate the process promoting uncontrollable combustion.

With the present blanket material, such a situation does not occur as the flame does not come into direct contact with the fuel, since if the flame front penetrates downwards below the upper surface of the blanket it will become extinguished as it meets a zone where the vapor/air mixture is vapor rich and above the upper limit of flammability, and moreover the supply of fuel to the frame front is restricted by the mechanisms discussed above. At the same time, the blanket material around the flame draws the heat away from the area continually particularly where the blanket material is a good heat conductor and dissipates it to the atmosphere. There will, of course, be a rise in temperature of the blanket material in the area of the flame and with it an increase in the rate of evaporation of the fuel, especially at the hot spots as less fuel vapors condense, but, the flame will not be out of control as will be the case in areas unprotected by the blanket material.

It will be noted that for effective flame-extinguishing action it is desirable that the blanket should have interstices of size sufficiently large that the material is flame-permeable i.e. that it permits propagation of a flame front into it when exposed to an ignited combustible air and vapor mixture, and that the adjacent platform elements are closely contiguous and that the blanket has its lower side immersed in the pool or in contact with its surface so that there are no gaps in which flames can break out. It is also important that the interstices be non-capillary so that wicking of liquid fuels to the upper surface of the blanket does not occur.

The above method may advantageously be employed to permit access for fire-preventative or fire-fighting crews through a pool of burning or potentially ignitable fluid e.g. to reach the seat of a fire or for permitting escape of persons trapped by such fluid or for permitting access of rescue personnel to such trapped persons through a pool of the fluid. "Flammable fluid" herein refers to liquids e.g. burning liquid fuels as well as flammable heavy vapors where the vapor forms a dense pool extending over a localised area of the ground surface, and in the latter context "the surface of the pool" is to be understood as referring to the interface between the dense fuel vapor and the ambient air.

By way of non-limiting example it may be mentioned that this method is applicable in the case of fire-fighting procedures conducted against fires in fuel tank farms where it may be necessary to traverse a pool of burning fuel in order to reach damaged valving equipment, ruptured tanks or pipelines from which a liquid or gaseous fuel is leaking, for the purpose of closing off the source of the leak and/or applying conventional fire-extinguishing measures. Further, the method is applicable in order to traverse pools of burning aviation fuel in order to apply fire-extinguishing procedures, or to provide a substantially flame-free corridor for escape from a crashed aircraft ringed by burning fuel.

By providing a pathway the upper surface of which is substantially free from flame, the method may permit escape of trapped persons in circumstances where this would otherwise be impossible and may permit fire-fighting operations such as those exemplified above to be conducted with reduced risk of fire-fighting crews suffering injury.

The present invention further provides apparatus for forming a traversable pathway through a pool of flammable fluid, comprising a plurality of platform elements each comprising a blanket of porous, non-capillary, heat-resistant material of thickness sufficient to prevent penetration of flame from the upper surface of the blanket to the flammable fluid when in contact with the lower surface of the blanket, the elements each being adapted to support the weight of one or more persons thereon without substantial deformation and being adapted to be deployed in contiguous end-to-end relationship to form a substantially continuous elongated pathway.

Preferred blanket materials include heat-conductive material such as metallic porous blankets. One particularly preferred material comprises a plurality of layers of expanded metal foil, for example expanded aluminium foil as described in U.S. Pat. No. 4,149,649 dated Apr. 13, 1979 in the name Andrew Szego, or as in U.S. Pat. No. 3,356,256 dated Dec. 5, 1967 in the name Joseph Szego, especially with reference to FIG. 9 thereof. This material is available under the trade mark EXPLOSAFE from the Explosafe Division of Vulcan Industrial Packaging Limited, Rexdale, Ontario, Canada.

This material is formed from a plurality of layers, each comprising a layer of expanded metal foil consisting of interconnected flat mesh strands which are each inclined at the same angle to the general plane of the layer, and which define between them diamond shaped openings. As commercially available this material has pores or interstices of relatively large size and is flame permeable. The interstices exhibit no capillary action, and therefore there is no capillary attraction of the liquid through the blanket, so that in use the upper level of the blanket does not become wetted when it is applied on an flammable fluid. Moreover, the aluminium foil is flame and heat resistant, and is relatively lightweight.

Similar pervious, flame-permeable, heat-resistant blanket materials that may be employed include materials of honeycomb sandwich construction, e.g. the metal honeycomb materials available under the trade mark HEXCEL, from Hexcel Corporation, Dublin, Calif., and knitted wire mesh products, as available under the trade mark METEX from Metex Corporation, Edison, N.J. Coherent woven, non-woven, or knitted blankets formed from inorganic filamentary materials, e.g. rock wools may also be employed.

It is however preferred to employ metallic, heat-conductive materials, as the heat-dissipating capacities of the conductive blankets can enhance the flame-extinguishing effect.

Examples of other blanket materials that may be flame-permeable depending on the pore size include fire-retardant polyurethane foams having large, non-capillary, open cells, the metal-plated plastics foams available under the trade mark RETIMET from Dunlop Limited, England, and ceramic foam such as the continuous open pore ceramic foam material available under the trade mark SELEE from Consolidated Aluminum Corporation, U.S.A.

DETAILED DESCRIPTION

Figure 1:
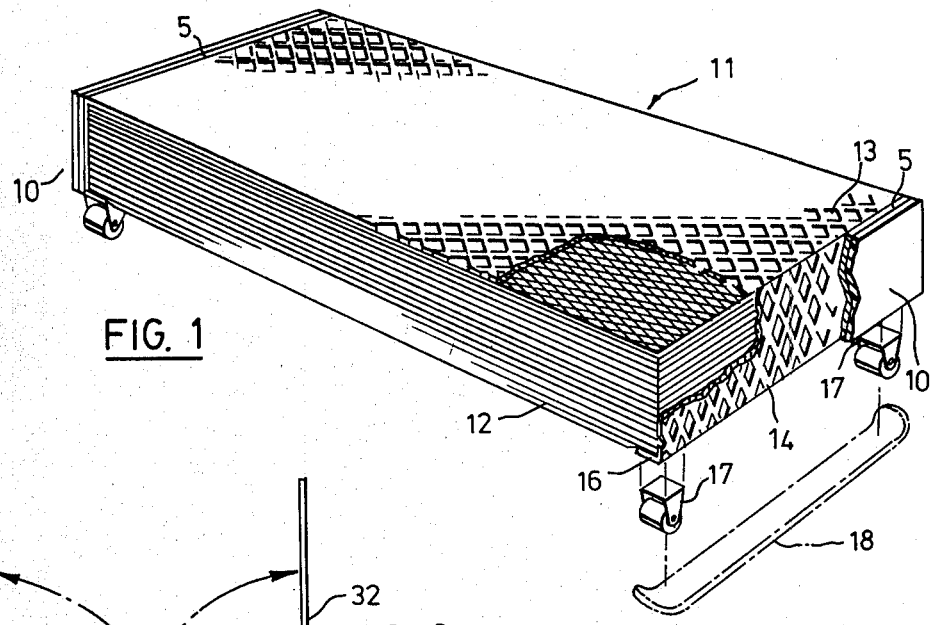
FIG. 1 shows a perspective view of one form of flame-extinguishing blanket element.

Referring to the drawings wherein like reference numerals indicate like parts. FIG. 1 shows a slab-like platform element 11 comprising a blanket 12 of multiple layer EXPLOSAFE (trade mark) expanded foil material provided on its upper surface with a load-distributing deck 13 of heavy gauge expanded metal or other relatively rigid flame-permeable heat-resistant material that permits the blanket to withstand the weight of at least one, or preferably several, persons without substantial deformation. This deck has rigid downward extensions 14 that transfer at least the major part of the load to a lower foot portion 16 so that the extensions 14 support the deck. With this arrangement the load is transferred to the ground, in the preferred form through one or more friction-reducing ground-engaging members e.g. rollers 17 or skids 18. These facilitate deployment of the platform elements over the surface of the ground. In the example illustrated, the sides of the deck 13 have an imperforate or other flame-impermeable heat resistant covering of metal sheeting 5, covered with a coating of heat-insulation material, preferably a coating of an intumescent heat-insulation material 10, to reduce the risk of melting or burning of the material 12 of the blanket during use. The coating 10 may be replaced after use, together with the sheeting 5 if necessary, thus allowing re-use of the platform element.

Figure 2:
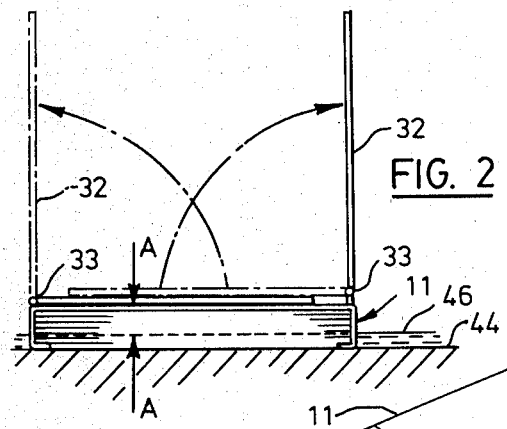
FIG. 2 is an end view of a modified form of the blanket of FIG. 1, resting on the surface of the ground.
Figure 3:
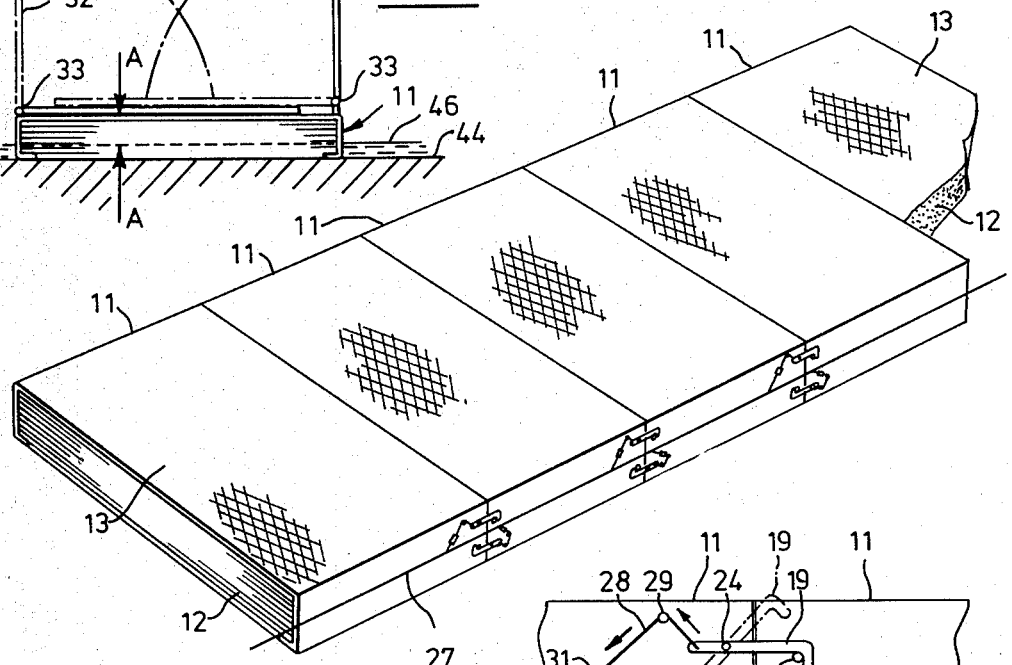
FIG. 3 shows a plurality of the elements of FIG. 1 interlinked to form a continuous flame-free pathway.
Figure 4:
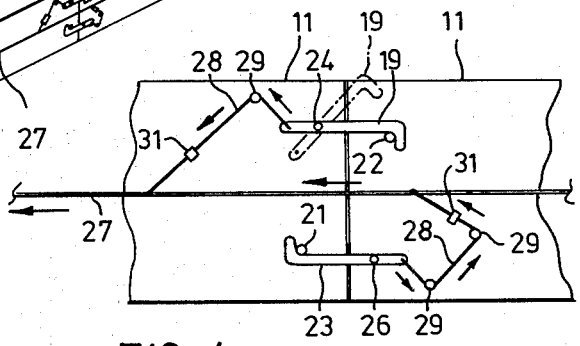
FIG. 4 is a side view on an enlarged scale of the blanket elements of FIG. 3 illustrating the interlinking means.

In use, as shown in FIG. 3, a plurality of the platform elements 11 are deployed in contiguous end-to-end relationship to form a continuous pathway. To avoid gaps between the ends of the elements in which flame could break out, the elements are provided with interlinking means which in the embodiment of FIGS. 2 and 3 take the form on the side adjacent one end of each element 11 of an upper pivoted catch 19 and a lower pin 21 and at the opposite end of each element a corresponding upper pin 22 and lower catch arm 23. The arms 19 and 23 pivot about points 24 and 26, respectively. Each arm 22 and 23 is connected to an actuating line 27 through line extensions 28 passing freely around guide pins 29 and through guiding staples 31. Normally, sufficient slack is maintained in the line 27 to permit the catch arms 19 and 23 to remain in a non-linking position, as indicated in broken lines for the arm 19 in FIG. 4. This permits the elements 11 to be stacked one upon another for convenient storage and at least permits articulation between adjacent elements 11 to facilitate handling and deployment of the elements. Once the elements 11 are deployed, the inter-linking arrangement is actuated by applying tension on the lines 27 and 28 so that the arms 19 and 23 are rocked from their storage positions to the positions shown in full lines in FIG. 4 wherein the arms 19 and 23 latch on the pins 22 and 21, respectively, to hold the blanket elements tightly together and to avoid separation of the adjacent elements. Other forms of inter-linking means may of course be employed.

In FIG. 2 there is shown a further modification in which an imperforate shield 32 e.g. of metal sheeting is pivoted at each side of the element 11 on a hinge 33. These side walls 32 may be spring-loaded or are in some other manner self-erecting, so that when the individual elements 11 are unstacked the shields 32 unfold from their lower storage position shown in broken lines to their upper position as indicated by the arrows in FIG. 2, in which they shield persons traversing the upper surface of the pathway from heat and flame in the surrounding area.

In use, in the event of a spill or leakage of flammable liquid or heavy vapour presenting a potential or actual fire hazard, a pathway of the platform elements 11, of sufficient thickness to exert a flame-extinguishing action on the flammable fluid concerned, is deployed across a pool of the flammable fluid with the lower surface of the element immersed in the fluid or in contact with its upper surface. FIG. 2 illustrates the platform element 11 supported on a ground surface 44 with its lower side immersed in a pool 46 of flammable liquid. The pathway formed by the elements 11 serves to provide a flame-free corridor through the pool of burning fluid in the event that the fluid becomes ignited, and, in typical application, as noted above, may be used to allow access to the seat of the fire for fire-fighting or fire-preventative personnel, or may be used to permit access of rescue personnel or to permit escape of trapped persons for example from crashed aircraft or in the event of spills or other escapes of fuels from large capacity fuel storage or processing facilities.

The thickness of blanket that is required to be exposed above the level of the liquid surface in order to provide a satisfactory fire-extinguishing action depends on the size of the pores or interstices in the blanket as well as on the flash point of the flammable liquid. The larger the pore size of the material of the blanket, and the lower the flash point of the flammable liquid concerned, the greater is the required thickness of blanket.

By way of example, it may be mentioned that a flame-extinguishing action, capable of extinguishing flames from a medium-range flash point solvent e.g. motor vehicle gasoline, can be obtained with a minimum thickness of the EXPLOSAFE expanded foil material above the liquid level 46, as indicated by the dimension A—A in FIG. 2, of about 10 cm. It is preferred to employ thicknesses somewhat greater than the practically-determined minimum, so as to allow a safety margin. Preferably, therefore, the thickness should be at least about 25 cm in the case of motor vehicle gasoline and other flammable liquids of medium flash point e.g. some commercial solvents. Somewhat greater thicknesses, e.g. up to about 50 cm may be desirable with flammable liquids of lower flash point, e.g. jet aviation fuel such as JP 4, and with lower flash point solvents such as toluene. Lesser thickness, e.g. of about 15 cm may be employable in the case of liquids of higher flash point, e.g. heavier oils.

In one form of trial for determining the flame-extinguishing properties of a particular porous blanket material and the appropriate thickness that should be used to obtain a flame-extinguishing effect, an open-topped metal vessel is filled with the porous material to be tested and varying quantities of the flammable fluid are introduced into the vessel.

The vessel may be equipped with a sight glass so that the depth of liquid under test and the thickness of the porous material extending above the liquid surface can be more easily measured. The flammable fluid are introduced into the vessel, ignited and the flame-extinguishing action is observed. If necessary, repeated trials can be conducted with differing thicknesses of material exposed above the liquid level so as to determine what thickness is required to give a desired short lapse of time between the ignition of the vapour and the extinguishing of the flames.

It will be appreciated that, employing the above form of trial, the flame-extinguishing properties and the required thickness are something that may be readily determined by trial and experiment in the case of any particular flammable fluid and any given porous blanket material.

Figure 7:
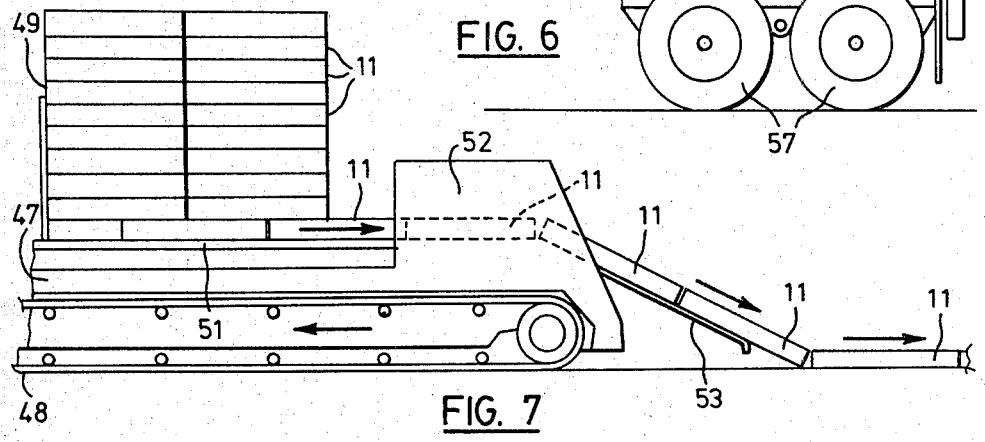
FIG. 7 shows, partly diagrammatically, one form of apparatus for deploying blanket elements.

Although in some circumstances it will be possible to deploy the platform elements manually from a stacked or otherwise stored condition, in many instances especially in a rescue operation, speed of deployment of the blanket elements is of the essence and in such case it is desirable to employ mechanised deployment apparatus to expedite the deployment of the elements and assembly of the flame-free pathway. One form of apparatus is illustrated in FIG. 7 comprising a track-laying vehicle having a vehicle body 47 and propulsion tracks 48. Supported on the body 47 is a magazine 49 of platform elements 11 in stacked configuration. In operation, the vehicle, which desirably is controlled remotely, is driven into and/or across a pool of burning or flammable fluid in order to lay a pathway into or across the pool. In the pathway-laying operation, the slab-like platform elements 11 are conveyed if necessary in a desired sequence from the magazine 49 by a conveyor 51 on the vehicle body to a coupler and assembler 52 where successive elements 11 are interlinked e.g. through an arrangement similar to that of FIGS. 3 and 4 and the elements are then fed down an exit ramp 53 as the vehicle 47 is propelled progressively along the desired path.

In an alternative arrangement rigid blanket elements which may be of relatively large length, e.g. of the order of 10 m, may be stacked on a mobile trailer or self-propelled vehicle equipped with means, e.g. pressure-operated rams, for pushing successive elements along the ground surface with the leading edge of each element abutting the trailing edge of the preceding element so that a flame-free pathway is progressively extended from the vehicle, which may be stationary or moving.

Figure 5:
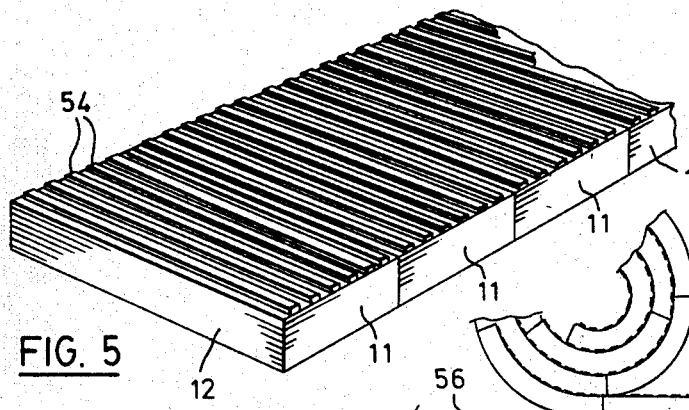
FIG. 5 is a perspective view of a further form of blanket element.
Figure 6:
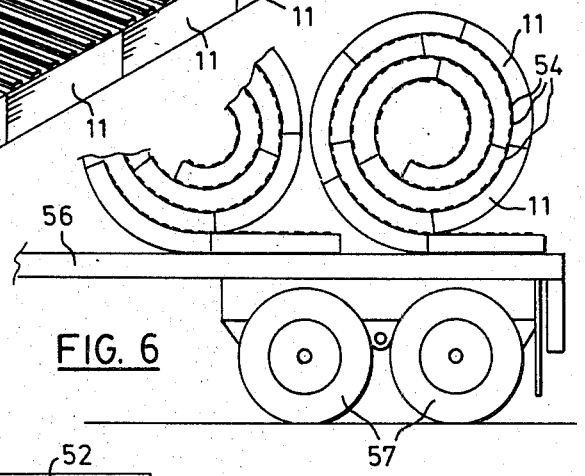
FIG. 6 shows the elements of FIG. 5 in a reeled-up state.

FIGS. 5 and 6 illustrate a further arrangement in which the deck on the supper surface of the platform elements 11 comprises load-distributing slats 54 extending transversely, permitting the flame-extinguishing material 12 of each element 11 to support the weight of one or preferably more persons. The slats 54 allow the material 12 of the elements 11, which have a certain degree of resilience and flexibility, to be reeled up into a coil for storage as indicated in FIG. 6 on the bed 56 of a mobile carrier having ground wheels 57. The carrier 56 can be driven or towed rapidly to the site of a fire hazard where the elements 11 can be uncoiled and deployed to form the desired pathway.

Figure 8:
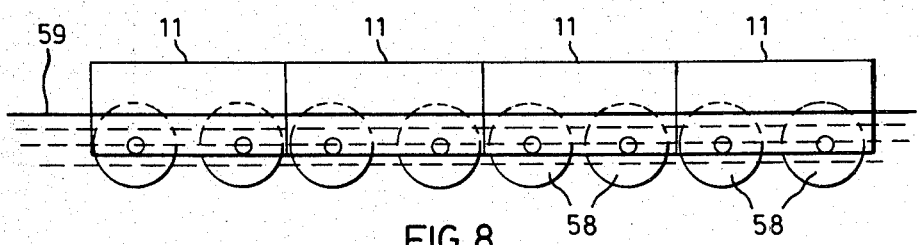
FIG. 8 shows a plurality of the blanket elements equipped with flotation means.

In some instances, the flame hazard may comprise a pool of liquid of substantial depth. For example, the pool of inflammable liquid may itself extend to substantial depth or the flammable liquid or vapor may form a layer on the surface of a body of water. These conditions are likely to be encountered in the case of spillages or leaks occurring in fuel storage tank farms, where it is conventional to surround each tank by a spillage-retaining dyke serving as a catchment of capacity sufficient to retain the entire contents of the tank in the event of rupture of the tank. Depending on the amount of spillage, these catchment dykes may become filled with a considerable depth of flammable fuel, or may contain pools of rain water of considerable depth, which, when a layer of flammable fuel is floating on the surface of the water, are a serious hazard to the safety of fire-preventative or fire-fighting crews seeking to traverse the catchment area to reach for example valving or ruptured piping or some other source of leakage of the contents of the fuel tank. In such case it is desirable to support the elements 11 on flotation means e.g. cylindrical floats 58 as shown in FIG. 8, the flotation means and the thickness of the elements 11 being arranged and selected so that when each element 11 supports the weight of one person, or in the preferred form, several persons, the upper surface of the element 11 maintains an appropriate flame-extinguishing distance above the surface 59 of the fuel or fuel and water mixture, while when the load on the element 11 is relieved, the lower surface of the element 11 remains immersed in the liquid so that there is no air space in which flames can break out.

I claim:

1. Apparatus for forming a traversable pathway through a pool of flammable fluid, comprising a plurality of platform elements each comprising a blanket of porous, non-capillary, heat-resistant material of thickness sufficient to prevent penetration of flame from the upper surface of the blanket to the flammable fluid when in contact with the lower surface of the blanket, the blanket material providing a myriad of small internal interstices and being relatively readily compressible or deformable, and each element having on its upper surface a relatively rigid load-distributing porous deck connected to downwardly depending members which support the deck whereby the elements are adapted to support the weight of one or more persons thereon without substantial deformation and said elements being adapted to be deployed in contiguous end-to-end relationship to form a substantially continuous elongated pathway.

2. Apparatus as claimed in claim 1 wherein the porous blanket comprises a good heat conductor.

3. Apparatus as claimed in claim 2 wherein the porous blanket is metallic.

4. Apparatus as claimed in claim 3 in which the porous material comprises superimposed layers of expanded metal foil.

5. Apparatus as claimed in claim 1 in which the porous material is selected from the group consisting of metal honeycomb material, knitted wire mesh, inorganic filamentary material, open cell plastics foam, metal-plated open cell plastics foam, and ceramic foam.

6. Apparatus as claimed in claim 1 wherein the deck comprises heavy gauge expanded metal.

7. Apparatus as claimed in claim 6 including a foot member on the lower surface of each element, said rigid support means connecting the foot and the deck.

8. Apparatus as claimed in claim 1 including a friction-reducing ground-engaging member on the lower surface of each element.

9. Apparatus as claimed in claim 8 wherein the ground-engaging member is a roller or a skid.

10. Apparatus as claimed in claim 1 in which each platform element is provided on opposite ends with interlinking means for attaching it in contiguous relationship with an adjacent platform element.

11. Apparatus as claimed in claim 1 in which each platform element has on each opposite side an imperforate heat-resistant covering for protecting the sides of the platform element from heat damage.

12. Apparatus as claimed in claim 11 in which the covering comprises an intumescent heat-insulating coating.

13. Apparatus as claimed in claim 1 in which each element has hinged on each side an imperforate shield which is pivotable from a lower folded position on the upper surface of the element to an erected position in which the shield extends upwardly from the side of the element.

14. Apparatus as claimed in claim 1 comprising a plurality of platform elements connected together end-to-end to form an elongated mat, the elements having sufficient flexibility to permit the mat to be reeled up to form a coil.

15. Apparatus as claimed in claim 1 further comprising a self-propelled vehicle, said platform elements being carried on the vehicle, and means on said vehicle for successively discharging the elements onto the ground as the vehicle is propelled along the ground, whereby the elements can be deployed to form a continuous pathway defined by the line of travel of the vehicle.

16. Apparatus as claimed in claim 1 wherein the thickness of the blanket is about 10 cm to about 50 cm.

17. A method for providing a traversable pathway through a pool of flammable fluid comprising: deploying in contact with the pool in contiguous end-to-end relationship a plurality of platform elements each comprising a blanket of porous, non-capillary, heat-resistant material with a thickness exposed above the surface of the pool sufficient to prevent penetration of flame from the upper surface of the blanket to the flammable fluid, the blanket material providing a myriad of small internal interstices and being relatively readily compressible or deformable, and each element having on its upper surface a relatively rigid load-distributing deck connected to downwardly depending members which support the deck so that the elements can support the weight of one or more persons thereon without substantial deformation, and thereby forming a substantially continuous elongated pathway.

18. A method as claimed in claim 17 in which the fluid is a liquid fuel.

19. A method as claimed in claim 17 in which the blanket comprises superimposed layers of expanded metal foil.

20. A method as claimed in claim 17 in which the blanket comprises a material selected from the group consisting of metal honeycomb material, knitted wire mesh, inorganic filamentary material, open cell plastics foam, metal-plated open cell plastics foam, and ceramic foam.

21. A method as claimed in claim 18 wherein the liquid has its flash point above about 30° C. and the thickness of the blanket material exposed above the surface of the liquid is about 10 to 25 cm.

22. A method as claimed in claim 18 wherein the liquid has its flash point below about 30° C. and the thickness of the blanket material exposed above the surface of the liquid is about 25 to 50 cm.

23. Apparatus for forming a traversable pathway through a pool of flammable fluid, comprising a plurality of platform elements each comprising a blanket of porous, non-capillary, heat-resistant material of thickness sufficient to prevent penetration of flame from the upper surface of the blanket to the flammable fluid when in contact with the lower surface of the blanket, each element having a relatively rigid load-distributing porous deck of heavy gauge expanded metal on its upper surface so that the elements can support the weight of one or more persons thereon without substantial deformation, a foot member on the lower surface of each element, and rigid support means connecting the foot and the deck, and the elements being adapted to be deployed in contiguous end-to-end relationship to form a substantially continuous elongated pathway.

* * * * *